US005882186A

United States Patent [19]

Kai Man

[11] Patent Number: 5,882,186

[45] Date of Patent: Mar. 16, 1999

[54] SLIP GUARD SAFETY LIGHTER

[76] Inventor: Aman Chung Kai Man, Unit 1, 11/F, Wah Lai Ind. Centre, 10-14 Kwei Tei Street, Fo Ian, Shatin, N.T., Hong Kong

[21] Appl. No.: 718,629

[22] Filed: Sep. 17, 1996

[51] Int. Cl.[6] ..... F23Q 1/02

[52] U.S. Cl. ..... 431/153; 431/277

[58] Field of Search ..... 431/277, 153

[56] References Cited

U.S. PATENT DOCUMENTS

| | | | |
|---|---|---|---|
| 3,938,943 | 2/1976 | Malamoud | 431/150 |
| 4,190,412 | 2/1980 | Nitta | 431/151 |
| 5,096,414 | 3/1992 | Zellweger | 431/277 |
| 5,364,261 | 11/1994 | Huang | 431/277 |
| 5,483,978 | 1/1996 | Doiron | 131/329 |

*Primary Examiner*—Carl D. Price

*Attorney, Agent, or Firm*—Trojan Law Offices; R. Joseph Trojan; Eric J. Aagaard

[57] ABSTRACT

A child resistant lighter comprising a standard lighter construction having a main body, a fuel reservoir, valve release means, and a spark wheel assembly, the improvement comprising a pair of slip guards, a plurality of contact wheels, and a strike wheel in which the slip guards have a greater radius than that of the contact wheels and strike wheel whereby the slip guards hinder a child's access to the contact wheels needed to operate the lighter.

6 Claims, 2 Drawing Sheets

68
76
48
40
64
42
74
32
34
28
30
13
15

80
72
60
78
15
36
54

SLIP GUARD SAFETY LIGHTER

FIELD OF THE INVENTION

This invention relates to child-resistant lighters.

BACKGROUND OF THE INVENTION

Various prior art cigarette lighters incorporating safety features are known. Safety features are generally provided to reduce the risk of injury to an operator or bystanders. Safety features for cigarette lighters can be divided into several general categories. Some safety mechanisms prevent ignition of a fuel source unless the lighter is properly oriented. Other mechanisms have been designed to automatically turn off a fuel supply valve. More recently, attention has been directed toward preventing ignition of the lighters by children and other persons normally not able to appreciate the danger of fire. Individuals usually considered in these efforts are young children, age five years and younger.

Child tamper-resistant mechanisms have focused on preventing depression of the thumb pad or thumb actuator found in most lighters by incorporating a locking mechanism that physically blocks the downward movement of the thumb pad unless a safety latch or other button is first engaged to unlock the lighter. There has also been development of guards that cover the spark wheel.

However, none of the prior inventions have incorporated safety guards as part of the support arms holding the spark wheel assembly. The guards prevent a child from effectively turning the spark wheel assembly. The guards incorporated into the support arms of the present invention, called slip guards, are larger in radius and smoother than the prior art spark wheels. The slip guards act as a mechanical barrier preventing a child's thumb access to the strike wheels. The slip guards frustrate young children attempting to operate the ignition mechanism of the lighter.

SUMMARY OF THE INVENTION is The present invention is directed to a child-resistant lighter. The lighter has slip guards, incorporated into the support arms which hold the spark wheel assembly, which make ignition of the lighter difficult by increasing the requisite amount of force and manual dexterity needed to rotate the spark wheel assembly to ignite the lighter. The present invention is also intended to take advantage of the smaller anatomical size of a child's fingers to hinder a child's ability to operate the lighter. Additionally, the invention is intended to add additional analytical steps to the child's mental process of understanding the operation of the lighter to further hinder the ability of small children to use the lighter.

These and other objects and advantages of the present invention will become apparent from the following detailed description of the preferred embodiment of the invention without intending to limit the scope of the invention which is set forth in the appended claims.

DETAILED DESCRIPTION OF THE DRAWINGS

The advantages of the invention can be more clearly understood by reference to the drawings in which.

DETAILED DESCRIPTION OF THE PREFERRED EMBODIMENT

Figure 1:
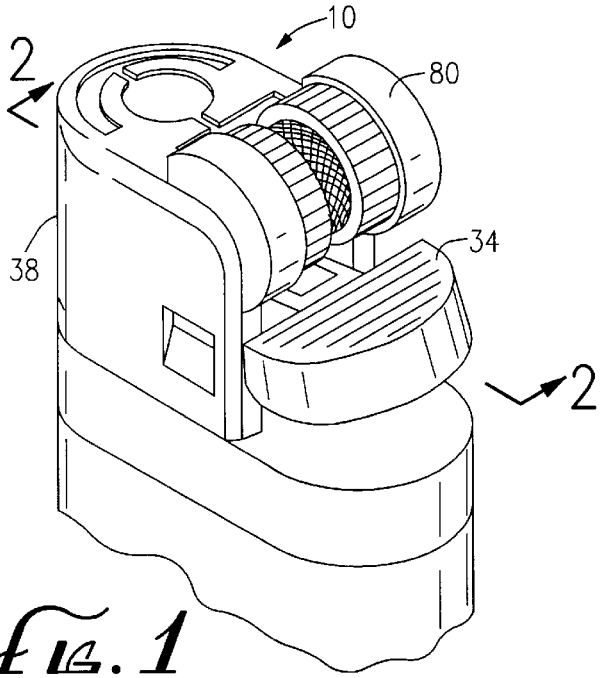
FIG. 1 is a perspective view of the invention
Figure 2:
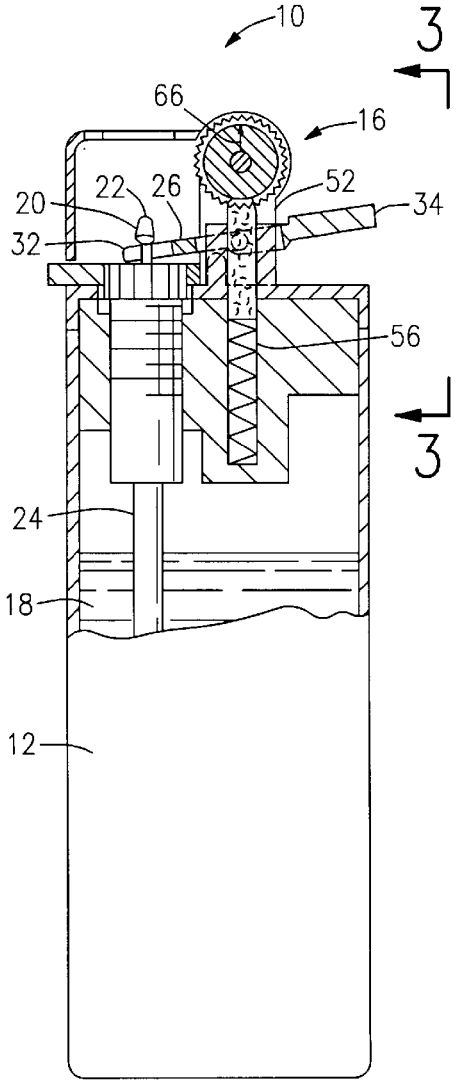
FIG. 2 is a cross-sectional view of the invention
Figure 3:
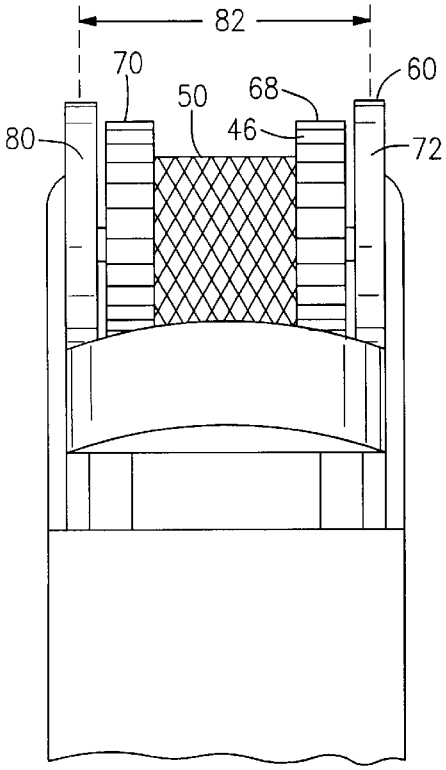
FIG. 3 is a rear view of the invention

FIGS. 1 and 2 generally illustrate the present invention 10, a child resistant lighter, in one of its preferred embodiments. The lighter 10 includes a main housing 12, which contains a standard fuel reservoir 14. The main housing 12 also includes a top end 13 from which support arms 15 project longitudinally.

Figure 4:
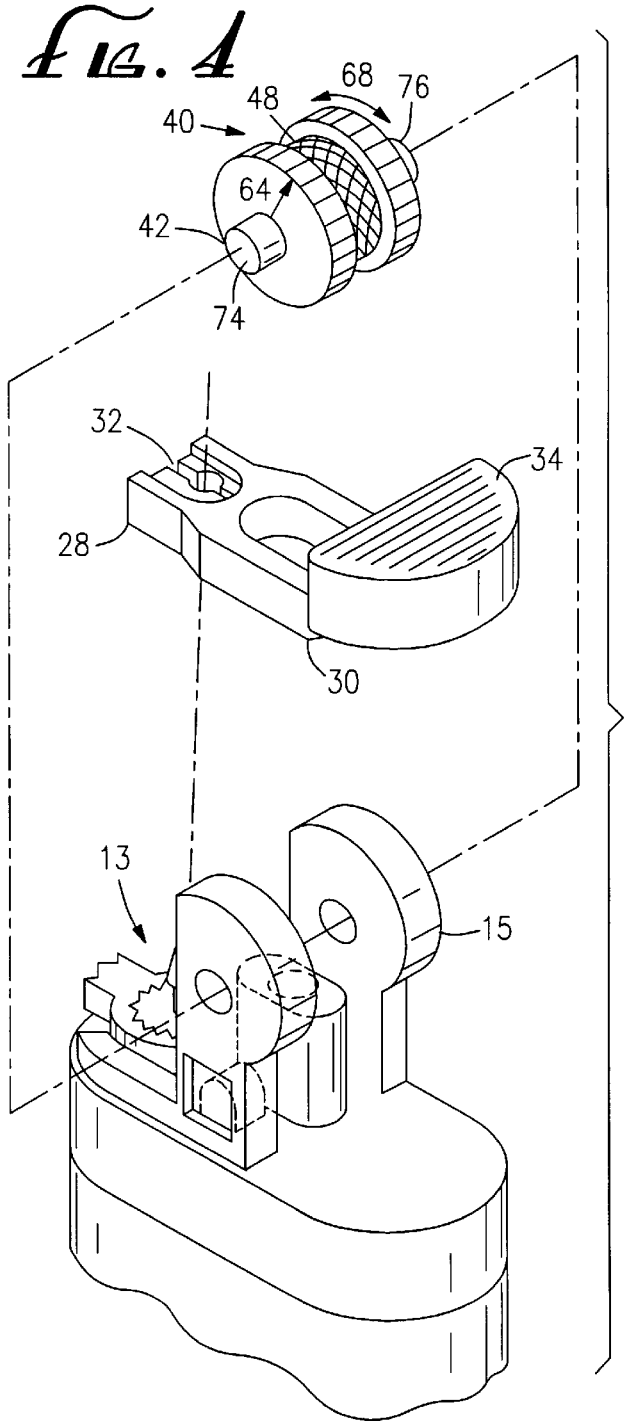
FIG. 4 is an exploded view of the invention

The top end 13 of the lighter 10 also generally has a conventional ignition mechanism 16 secured thereto. As shown in FIGS. 1 through 4, the ignition mechanism 16 includes any standard means for the controlled release of a combustible fuel 18 from a reservoir 14. As shown in FIGS. 2 and 4, such a fuel release means 20 may include a valve 22 connected to a tube 24 that draws on fuel in the reservoir 14. The valve 22 is typically moved to the open position by operation of a release lever 26. The release lever 26 has an interior end 28 and an exterior end 30. The interior end 28 has a prong 32 formed therein for engaging the valve 22. The exterior end 30 has a finger pad 34 for depressing the lever 26. The release lever 26 also includes hinging means 36, which are formed on the top end 13 thereby permitting the lever 26 to pivot when in operation. A standard wind screen 38 fits over and encloses the valve 22 and a portion of the support arms 15.

The ignition mechanism 16 also includes a spark wheel assembly 40. The spark wheel assembly 40 includes an axle 42, contact wheels 46, and a strike wheel 48. The strike wheel 48 has a rough surface 50 and is centrally located on the axle 42 so that it is positioned to come in contact with a flint 52. The flint 52 is contained with an elongated receptacle 54 and is biased upward against the strike wheel 48 by a spring 56 positioned below the flint 52 in the receptacle 54. During operation, the strike wheel 48 rotates while in contact with the flint 52. The surface 50 of the strike wheel 48 must have a sufficient coefficient of friction to generate a spark when rotated in contact with the flint 52. Typically, the strike wheel 48 is rigidly fixed to the axle 42 such that it can only rotate if the axle 42 rotates.

Figure 5:
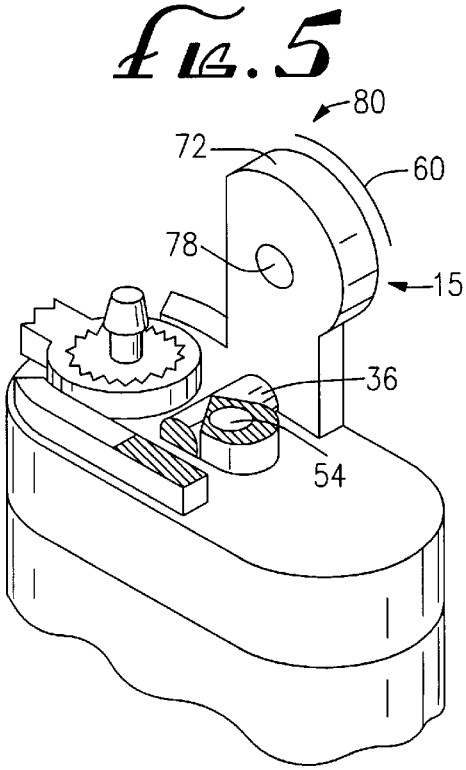
FIG. 5 is a partial cross-sectional view of the invention.

Incorporated into the support arms 15 is the new and novel improvement of the present invention. As stated, the main housing 12 also includes a top end 13 from which support arms 15 project longitudinally. The axle 42 itself is elongated and has a first end 74 and a second end 76. Each support arm 15 has a mounting means 78 positioned opposite one another for receiving the first and second ends 74, 76 of the axle 42 thereby supporting the spark wheel assembly 40 above the flint 52 within the lighter 10. In the preferred embodiment of the invention, best depicted in FIG. 5, the support arms 15 have axle holes 78 for supporting the spark wheel assembly 40.

The tops of the support arms 15 are slip guards 80. The preferred embodiment of the slip guards 80 have a radial edge 60. The contact wheels 46 each have a radial edge 68 having a surface 70, which is sufficiently rough to prevent slippage when a human finger engages the surface 70 for purposes of rotating the contact wheels 46. In contrast, the radial edge 60 of the slip guards 80 have a surface 72 that is generally smooth for the intended purpose of inhibiting contact with, and thereby rotation of, the spark wheel assembly 40 by a human finger.

The slip guard 80 has a radius 62, the contact wheel has a radius 64, and the strike wheel has a radius 66. It is essential to the invention that the slip guard radius 62 be greater than both the contact wheel radius 64 and the strike wheel radius 66 for the invention to operate effectively. The contact wheel radius 64 can be greater or equal to the strike wheel radius 66. This is true for the following reasons:

The slip guard radius 62 is larger than the contact wheel radius 64 so that the slip guard 80 will act as a physical barrier to prevent the user's thumb from fully engaging the contact wheel 46. The distance 82 between the slip guards 80 is such that a young child's thumb will not fit between the guards 80. If the child's thumb is narrow enough to fit between the guards 80, the child is likely to be either too young and/or not strong enough to rotate the spark wheel assembly 40.

An adult's thumb has sufficient mass to deform between the guards 80 and make contact with the contact wheels 46 and rotate the assembly 40. The lighter is difficult for a young child to operate because a child's thumb is not sufficiently large to deform past the slip guard 80 to engage the contact wheel 46. Federal regulations governing child resistant cigarette lighters are directed to primarily protecting children in the age range from 42 months to 51 months old. The inventor has observed that a child's thumb in this age range is roughly 42 millimeters in circumference, 15 millimeters in width from side to side across the top of the nail, and 12 millimeters in depth from the top of the nail to the bottom of the thumb pad. In the preferred embodiment, the distance 82 between the two slip guards 80 is approximately 6.99 millimeters and the depth from the top of the slip guards 80 to the top of the contact wheels is approximately 0.71 millimeters. Given that the slip guards 80 are positioned closer together than the width of the child's thumb, it is difficult for the child to fit his or her finger between the slip guards 80. Furthermore, considering that the height of the slip guards is slightly greater than the height of the contact wheels, it is difficult for a child to deform his or her thumb to make sufficient frictional contact with the contact wheels 46.

Moreover, the slip guard surface 72 is smooth and is not attached to the axle 42. Thus, without sufficient force, the user's thumb will slip off the slip guard 80 without causing rotation of the axle 42 and operation of the lighter 10. Hence, the lighter will not operate unless sufficient pressure is applied so that the user's thumb deforms past the slip guard 80 to frictionally engage the contact wheel 46 thereby turning the axle 42 and attached strike wheel 48.

Children have also been know to run the wheels of a lighter along a floor or other surface to generate amusing sparks and possibly flames. When the lighter 10 is abused by children in such a manner, the slip guards 80 help to serve to inhibit the generation of sparks and flames under such conditions. At the very least, this feature will hopefully delay the generation of sparks and flames to allow time for a supervising adult to intercede.

Although the present invention has been described in considerable detail with reference to certain preferred versions thereof, other versions are possible. For example, the slip guards 80 could be coated with a slippery substance such as teflon or the surface 72 polished smooth. Therefore, the spirit and scope of the appended claims should not be limited to the description of the preferred versions contained herein.

What is claimed is:

1. A child resistant lighter having a lighter housing defining a reservoir for containing a combustible fuel, a fuel release means in communication with said reservoir, including a valve means cooperating with a release lever for selective actuation between a normally closed valve position, which prevents exit of said combustible fuel from said reservoir, and an open position which permits exit of combustible fuel from said reservoir through said valve means, said release lever including a thumb pad for actuation of said lever by a user, an axle rotatably engaging a set of support arms projecting from said lighter housing, a strike wheel having a radius and fixed about said axle for interacting with a flint biased against said strike wheel, the improvement comprising:

a pair of slip guards integral to each of said support arms, each slip guard having an interior side, an exterior side, a slip guard radius, and a radial edge, each slip guard of said pair positioned on said axle on opposite sides of said strike wheel such that said interior side of each of said slip guards faces said strike wheel, a pair of contact wheels, each having a radius and each fixed on said axle with each contact wheel of said pair positioned on opposite sides of said strike wheel and next to said interior side of said slip guards; and, said radius of said slip guards are greater than said radius of said contact wheels and said strike wheel whereby said lighter is resistant to operation by children.

2. A child-resistant lighter having a lighter housing defining a reservoir for containing a combustible fuel, a fuel release means in communication with said reservoir, including a valve means cooperating with a release lever for selective actuation between a normally closed valve position, which prevents exit of said combustible fuel from said reservoir, and an open position which permits exit of combustible fuel from said reservoir through said valve means, said release lever including a thumb pad for actuation of said lever by a user, an axle rotatably engaging a set of support arms projecting from said lighter housing, a strike wheel having a radius and fixed about said axle for interacting with a flint biased against said strike wheel, the improvement comprising:

a pair of slip guards, each slip guard integral to one of said support arms, each having an interior side, an exterior side, and a radius and a radial edge, each slip guard of said pair positioned on said axle on opposite sides of said strike wheel such that said interior side of each of said slip guards faces said strike wheel;

a pair of contact wheels, each having a radius and each fixed on said axle with each contact wheel of said pair positioned on opposite sides of said strike wheel and next to said interior side of said slip guards; and, said radius of said slip guards are greater than said radius of said contact wheels and said strike wheel whereby said lighter is resistant to operation by children.

3. A child resistant lighter as in claim 2 in which each radius of said contact wheels is greater than said radius of said strike wheel.

4. A child resistant lighter as in claim 2 in which said slip guards have a radial edge having a surface, said surface being smooth.

5. A child resistant lighter as in claim 2 in which said interior side of each said slip guard is substantially flush against one of said contact wheels.

6. A child resistant lighter as in claim 2 further comprising a distance between said slip guards, said distance being no more than 15 millimeters.

* * * * *